US012690636B2

(12) United States Patent
Brock et al.

(10) Patent No.: US 12,690,636 B2
(45) Date of Patent: Jul. 28, 2026

(54) PROTECTIVE CAP

(71) Applicant: Milwaukee Electric Tool Corporation, Brookfield, WI (US)

(72) Inventors: Michael James Brock, Sussex, WI (US); Aqheel Mohammad, Brookfield, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 56 days.

(21) Appl. No.: 18/500,389

(22) Filed: Nov. 2, 2023

(65) Prior Publication Data

US 2024/0197024 A1 Jun. 20, 2024

Related U.S. Application Data

(60) Provisional application No. 63/387,421, filed on Dec. 14, 2022.

(51) Int. Cl.
*A42B 3/12* (2006.01)
*A42B 3/28* (2006.01)

(52) U.S. Cl.
CPC ..... *A42B 3/125* (2013.01); *A42B 3/283* (2013.01)

(58) Field of Classification Search
CPC ..... A42B 3/125; A42B 3/283; A42B 3/324; A42B 1/08; A42B 3/069; A42B 3/12; A42B 3/124; A42B 3/127; A42B 3/128
See application file for complete search history.

(56) References Cited

U.S. PATENT DOCUMENTS

| | | | | |
|---|---|---|---|---|
| 6,453,476 | B1 * | 9/2002 | Moore, III | A42B 3/125 2/412 |
| D867,672 | S | 11/2019 | Votel et al. | |
| 10,687,574 | B2 | 6/2020 | Williams et al. | |
| 10,779,599 | B2 | 9/2020 | Votel et al. | |
| 10,827,794 | B2 | 11/2020 | Votel et al. | |
| 10,959,480 | B2 | 3/2021 | Shiffer | |
| D964,661 | S * | 9/2022 | Skemp | D29/102 |
| D964,662 | S * | 9/2022 | Votel | D29/102 |
| D1,002,115 | S * | 10/2023 | Qiu | D29/122 |
| D1,055,395 | S * | 12/2024 | Gallant | D29/102 |
| 2009/0222975 | A1 * | 9/2009 | Green | A42C 5/02 2/181 |
| 2011/0307997 | A1 * | 12/2011 | Blair | A42B 3/128 2/414 |
| 2014/0215694 | A1 * | 8/2014 | Grice | A42B 3/064 2/411 |

(Continued)

FOREIGN PATENT DOCUMENTS

| | | |
|---|---|---|
| CN | 201091250 | 7/2008 |
| CN | 204617174 | 9/2015 |

(Continued)

*Primary Examiner* — Clinton T Ostrup
(74) *Attorney, Agent, or Firm* — Reinhart Boerner Van Deuren s.c.

(57) ABSTRACT

A protective cap including an outer shell and an impact absorbing liner are constructed of materials designed to provide impact protection to a wearer. In some embodiments, the outer shell includes an outer surface pattern and/or an inner surface pattern to provide better grip and reduce rotation between the outer shell and the impact absorbing liner and/or the outer shell and a hat the user wears to cover the protective cap.

17 Claims, 15 Drawing Sheets

(56) References Cited

U.S. PATENT DOCUMENTS

| | | | | |
|---|---|---|---|---|
| 2014/0230133 | A1 | 8/2014 | Roberts | |
| 2018/0000185 | A1 | 1/2018 | Castro et al. | |
| 2018/0192723 | A1 | 7/2018 | Williams et al. | |
| 2018/0279711 | A1* | 10/2018 | Szalkowski | A42B 3/32 |
| 2019/0090573 | A1* | 3/2019 | Votel | A42B 1/08 |
| 2019/0110545 | A1* | 4/2019 | Lee | A42B 3/12 |
| 2020/0077730 | A1 | 3/2020 | Blaxter, III et al. | |
| 2020/0121016 | A1 | 4/2020 | Skemp et al. | |
| 2021/0212407 | A1 | 7/2021 | Shiffer | |
| 2021/0259349 | A1 | 8/2021 | Sanchez et al. | |
| 2021/0282492 | A1 | 9/2021 | Skemp et al. | |
| 2021/0352992 | A1 | 11/2021 | Worple et al. | |
| 2022/0386735 | A1* | 12/2022 | Agustsson | A42B 3/283 |

FOREIGN PATENT DOCUMENTS

| | | | | |
|---|---|---|---|---|
| CN | 213695890 | | 7/2021 | |
| CN | 214904147 | | 11/2021 | |
| CN | 215649466 | | 1/2022 | |
| CN | 114009888 | | 2/2022 | |
| DE | 202004012916 | U1 * | 12/2004 | A42B 3/062 |
| DE | 202011107349 | | 1/2012 | |
| WO | WO2004016122 | | 2/2004 | |

* cited by examiner

PROTECTIVE CAP

CROSS-REFERENCE TO RELATED PATENT APPLICATION

The present application claims the benefit of and priority to U.S. Provisional Application No. 63/387,421 filed on Dec. 14, 2022, which is incorporated herein by reference in its entirety.

BACKGROUND OF THE INVENTION

The present invention relates generally to the field of protective equipment. The present invention relates specifically to various protective cap or bump cap designs constructed with materials to provide added protection to a user's head from impacts and/or bumping of the wearer's head. Protective caps are less bulky and have lower profiles than protective helmets or hard hats.

SUMMARY OF THE INVENTION

One embodiment of the invention relates to a protective cap. The protective cap includes an outer shell. The outer shell includes an exterior surface, an interior surface defining a cavity sized to receive a head of a user, and a crown portion. The exterior surface includes a patterned portion. The patterned portion is configured to engage an inner surface of headwear covering the protective cap. The crown portion is configured to cover part of the head of the user. The outer shell further includes a bottom segment. The bottom segment defines a lower circumference of the outer shell. The protective cap further includes an impact absorbing liner positioned within the outer shell and engaged with the interior surface of the outer shell. The exterior surface of the outer shell includes a pattern that engages an inner surface of a hat covering the protective cap.

Another embodiment of the invention relates to a bump cap. The bump cap includes an outer shell. The outer shell includes an exterior surface, an interior surface, a crown portion, and a bottom segment. The exterior surface includes a patterned portion. The interior surface defines a cavity sized to receive a head of a user. The crown portion is configured to cover part of the head of the user. The bottom segment defines a lower circumference of the outer shell. the outer shell further includes a front portion, a rear portion, a pair of side portions, and a trimmable section. The rear portion opposes the front portion. The pair of side portions extend downward from the crown portion and are positioned between the front portion and the rear portion. The trimmable section extends along the bottom segment of each of the pair of side portions. The trimmable section includes a shoulder extending along a longitudinal axis of the bump cap. The bump cap further includes an impact absorbing line positioned within the outer shell and coupled to the interior surface of the outer shell.

Another embodiment of the invention relates to a bump cap. The bump cap includes an outer shell. The outer shell includes an exterior surface, an interior surface defining a cavity sized to receive a head of a user, a crown portion, and a bottom segment. The crown portion is configured to cover part of a head of the user. The bottom segment defines a lower circumference of the outer shell. The outer shell further includes a plurality of protruding structures extending away from the exterior surface and a plurality of sunken sections. Each sunken section is positioned within the protruding structure and recessed relative to the protruding structure. The bump cap further includes an impact absorbing liner positioned within the outer shell and engaged with the interior surface of the outer shell.

In a specific embodiment, the interior surface of the outer shell includes a pattern that engages an outer surface of the impact absorbing liner. The engagement between the outer shell and the impact absorbing liner is configured to reduce rotation between the outer shell and the impact absorbing liner. In a specific embodiment, the outer shell includes a shoulder positioned between a thick portion of the outer shell and a trimmable portion of the outer shell.

Additional features and advantages will be set forth in the detailed description which follows, and, in part, will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
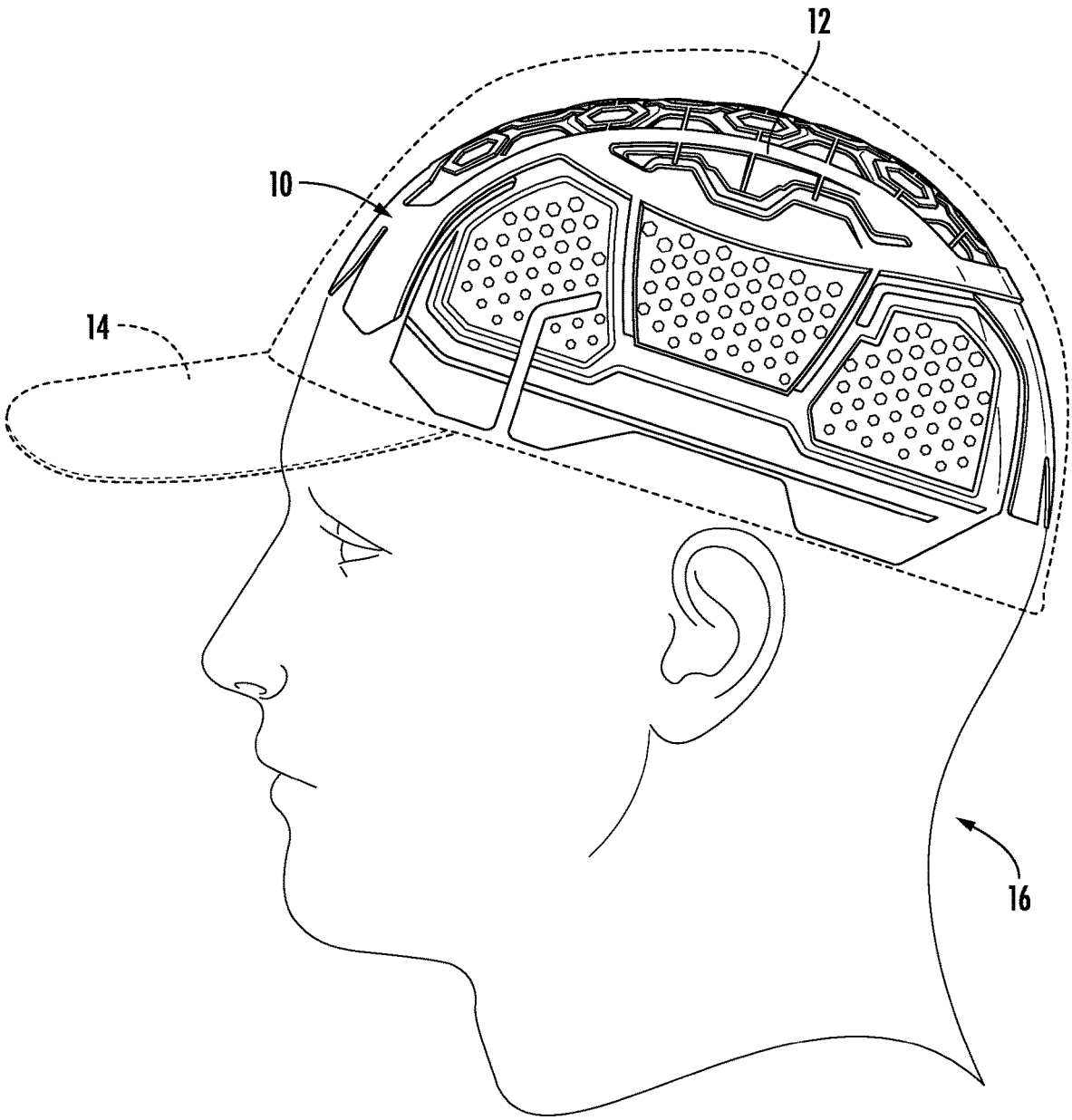
FIG. 1 is a side view of a bump cap on the head of a wearer with the impact absorbing liner removed, according to an exemplary embodiment.

Referring generally to the figures, various embodiments of a protective cap, shown as a bump cap are shown. As will be generally understood, many conventional hard hats are designed to provide impact protection from falling objects, while bump caps provide protection when a wearer is concerned with lower level impacts, such as bumping their head. Bump caps have a lower profile and are less bulky than hard hats allowing bump caps to be worn under a hat or other headwear, if desired. Various embodiments of the bump cap discussed herein include various designs and materials that provide an improved ability to absorb impacts (i.e., bumping head on objects, ceiling, piping, underside of a vehicle, etc.). Specifically, the various bump cap designs include an outer shell and an impact absorbing liner positioned within the outer shell.

Applicant believes the bump cap designs discussed herein provides impact absorption to a wearer while having a lower profile (i.e., slimmer, less bulky) than conventional bump caps or other head protection (i.e., hard hats). In some embodiments, Applicant has designed a bump cap that utilizes the materials and structures discussed herein to provide improved structural performance allowing for the design of a bump cap with low profile. Such design improvements allow for a bump cap that provides a high level of protection while at the same time allowing for more user comfort and the flexibility for using the bump cap with a variety of covers (i.e., hats, caps, etc.), which is particularly important in the context of a protective cap in which users may wear the device for many hours spanning a workday/shift.

Additionally, in various embodiments of the bump cap discussed herein, the outer shell includes an outer surface pattern. Applicant believes the outer surface pattern provides a grip between the bump cap and a hat the user may wear over the bump cap, reducing rotation and/or relative movement between the bump cap and hat and improving impact performance. Vent holes and/or channels are positioned within recessed portions of the outer shell, providing a pathway for airflow within the bump cap. In some embodiments, the outer shell of the bump cap includes a surface pattern on the inner surface (i.e., surface engaged with impact absorbing liner) to grip and/or secure the impact absorbing liner to the outer shell and reduce rotation between the outer shell and the impact absorbing liner. In a specific embodiment, the impact absorbing liner includes a structure (i.e., plugs, clips, etc.) to mechanically secure the impact absorbing liner to the outer shell. In a specific embodiment, the impact absorbing liner is coupled to the outer shell using hook and loop fasteners or structures.

Further, in various embodiments, the outer shell of the bump cap includes a thinned portion, allowing for easy trimming and customization of the bump cap to fit within a chosen hat. Specifically, the trimmable portion includes a step or shoulder transitioning between the thicker portion of the bump cap and the trimmable portion. Similarly, some embodiments include vertical (i.e., extending towards the crown) slots in a front portion of the outer shell that allow the outer shell to accommodate a variety of head sizes and hair styles.

Referring to FIG. 1, a perspective view of a protective hat or cap, shown as bump cap 10, is shown according to an exemplary embodiment. Bump cap 10 includes a protective outer shell 12 and an impact absorbing liner 60 (see e.g., FIG. 4). In a specific embodiment, outer shell 12 is formed from a rigid material, such as a rigid polymer material. Outer shell 12 includes an exterior surface 18 and an interior surface 20 (see e.g., FIGS. 2-3). Interior surface 20 defines a cavity 22 (see e.g., FIG. 2) sized to receive a head of a user and/or wearer 16. Exterior surface 18 of outer shell 12 faces and/or engages with an inner surface of a hat or cap 14.

Figure 2:
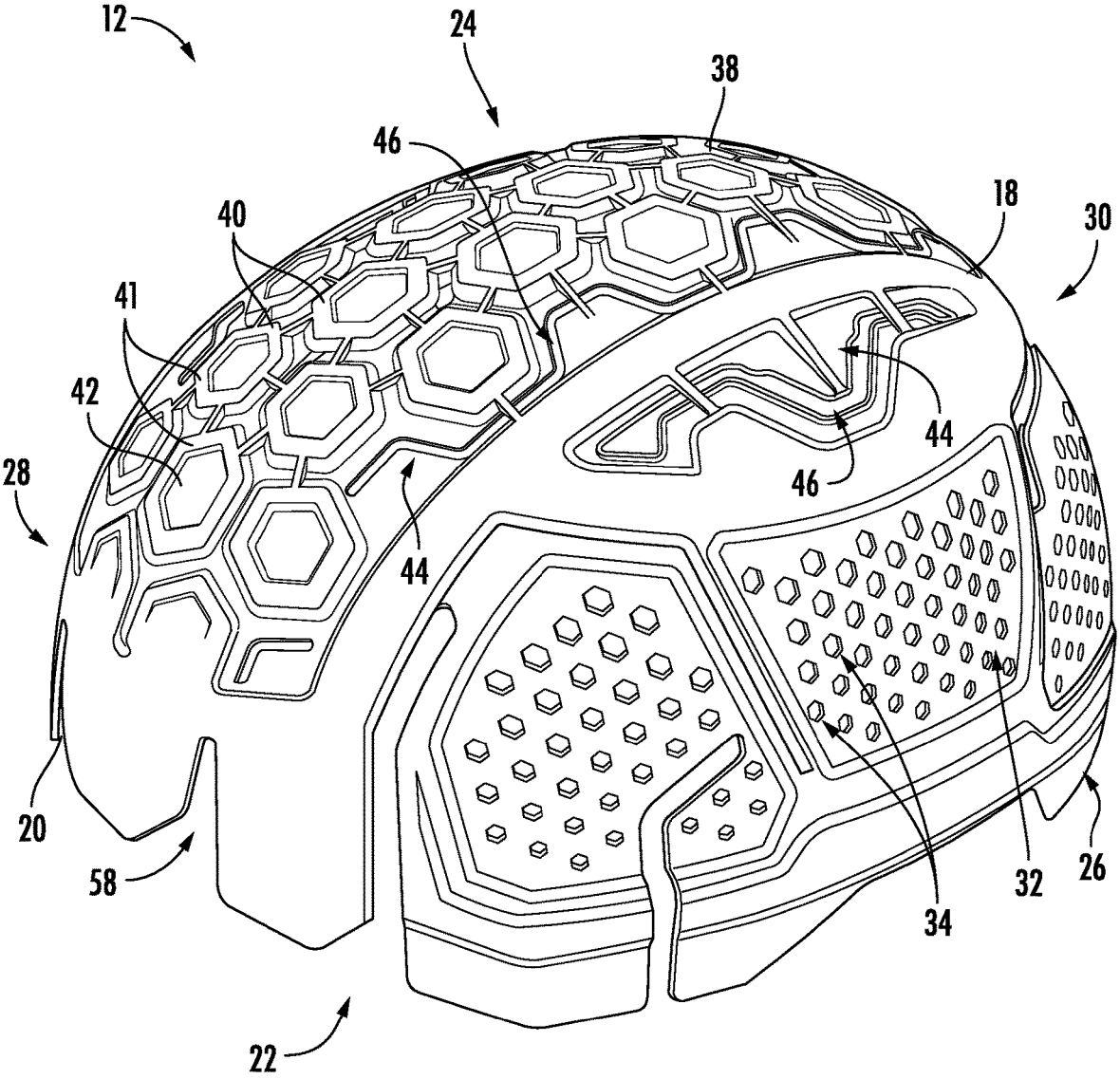
FIG. 2 is a perspective view from above of the outer shell of the bump cap of FIG. 1, according to an exemplary embodiment.
Figure 3:
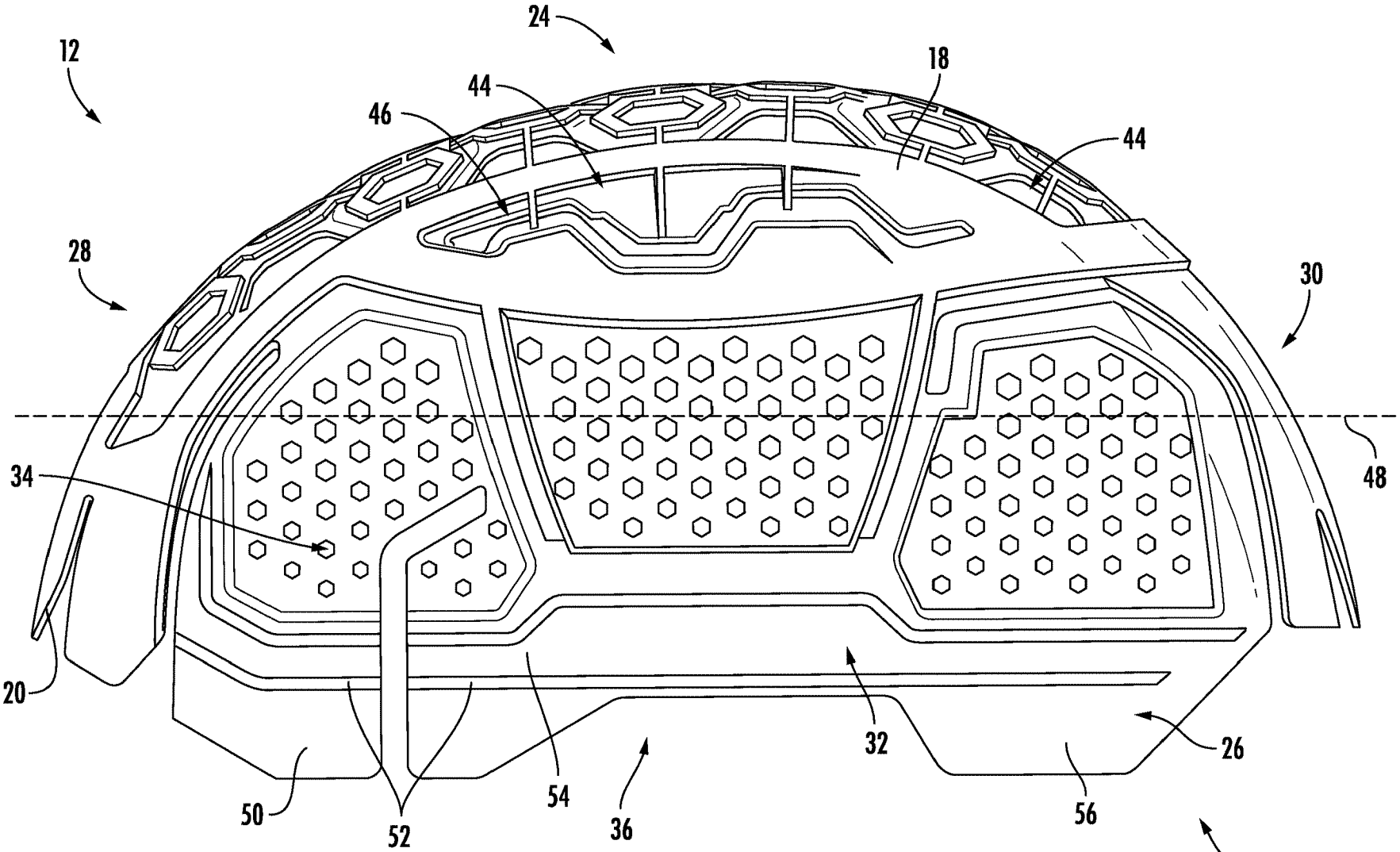
FIG. 3 is a side view of the outer shell of the bump cap of FIG. 1, according to an exemplary embodiment.

Referring to FIGS. 2-3, details of protective outer shell 12 are shown, according to an exemplary embodiment. Outer shell 12 includes a crown or crown portion 24 and a bottom segment 26 defining a lower circumference of outer shell 12. Outer shell 12 further includes a front portion 28 and a rear portion 30 that opposes front portion 28. A pair of opposing side portions 32 of outer shell 12 extend downward (i.e., toward wearer 16) from the crown 24 between front portion 28 and rear portion 30.

Outer shell 12 further includes a plurality of apertures or vents 34. Vents 34 extend through outer shell 12 providing fluid communication between cavity 22 and the ambient air proximate to exterior surface 18 of outer shell 12. In a specific embodiment, vents 34 are positioned along opposing side portions 32 of outer shell 12. In other embodiments, vents 34 are positioned on other portions of outer shell 12 (i.e., crown, front, rear, etc.). Outer shell 12 further includes recessed section 36 positioned between the front 28 and rear 30 portions of bump cap 10 proximate to the ears of wearer 16. In a specific embodiment, recessed section 36 extends a height above a portion of bottom segment 26 proximate to the front 28 and/or rear 30 portions of bump cap 10.

Exterior surface 18 of outer shell 12 and specifically crown 24 includes a patterned or textured portion 38. As discussed above, Applicant believes the patterned portion 38 on outer shell 12 provides a grip between the bump cap 10 and a hat 14 the user 16 may wear over the bump cap 10, reducing rotation between the exterior surface 18 of outer shell 12 and an inner surface of hat 14. In other words, when patterned portion 38 engages the hat 14, the patterned portion 38 resists rotation of the hat such that the rotation between the bump cap 10 and hat 14 is reduced.

In a specific embodiment, the patterned portion 38 extends along crown 24 between front portion 28 and rear portion 30 of outer shell 12. Patterned portion 38, include raised or protruding structures 40 while other sections are sunken central areas 42. In such embodiments, protruding structures 40 each have an outer surface 41, and outer surfaces 41 of protruding structures 40 together define the outermost surface of the crown 24 of bump cap 10. In a specific embodiment, patterned portion 38 includes a hexagonal shaped pattern. In other embodiments, patterned portion 38 is a different shape (i.e., triangular, square, etc.).

Outer shell 12 further includes one or more recessed portions 44. Recessed portions 44 are positioned between crown 24 and opposing side portions 32 of outer shell 12. In such embodiments, recessed portions 44 are recessed below both protruding structures 40 and sunken central areas 42 of the patterned portion 38.

Vent channels 46 are positioned within recessed portions 44. Vent channels 46 extend through outer shell 12 providing fluid communication between cavity 22 and the ambient air proximate to exterior surface 18 of outer shell 12. Applicant believes that by locating vent channels 46 within recess portions 44 (and located below/closer to the wear's head than the outer surfaces 41 of protruding structure 40) that airflow is improved. Vent channels 46 extend between front portion 28 and rear portion 30 of outer shell 12 generally in a direction of a major or longitudinal axis 48 of bump cap 10. In various embodiments, vent channels 46 extend in a non-linear manner (i.e., are stepped or have a pattern). In a specific embodiment, vent channels 46 extend in the shape of the patterned portion 38 (i.e., trapezoidal or half of a hexagon).

Referring to FIG. 3, each opposing side portion 32 includes a trimmable section 50 along bottom segment 26. Trimmable section 50 includes a step or shoulder 52 transitioning between a first, thick portion 54 of the bump cap 10 and/or outer shell 12 and a second, thin portion 56 that is easily trimmable. In other words, the shoulder 52 is a stepped transition between thick portion 54 and thin portion 56 of outer shell 12. In a specific embodiment, the shoulder 52 extends along the longitudinal axis 48. As previously discussed, thin portion 56 of outer shell 12 allows for easy trimming and customization of the bump cap 10 to fit within a specific hat 14. Thick portion 54 has a first thickness T1, and thin portion has a second thickness T2. In a specific embodiment, T1 is different than T2. In a specific embodiment, T1 is greater than T2.

Referring to FIG. 2, front portion 28 of outer shell 12 further includes one or more vertical slots 58. Vertical slots 58 extend from bottom segment 26 toward crown 24 of outer shell 12. In a specific embodiment, vertical slots 58 extend in a generally perpendicular (e.g., 90 degrees plus or minus 10 degrees) direction to longitudinal axis 48. In various embodiments rear portion 30 of outer shell 12 further includes one or more vertical slots 58. Vertical slots 58 allow the outer shell 12 to accommodate a variety of user 16 head sizes and/or hair styles by providing additional flexibility and/or space at front portion 28 and/or rear portion 30.

Figure 4:
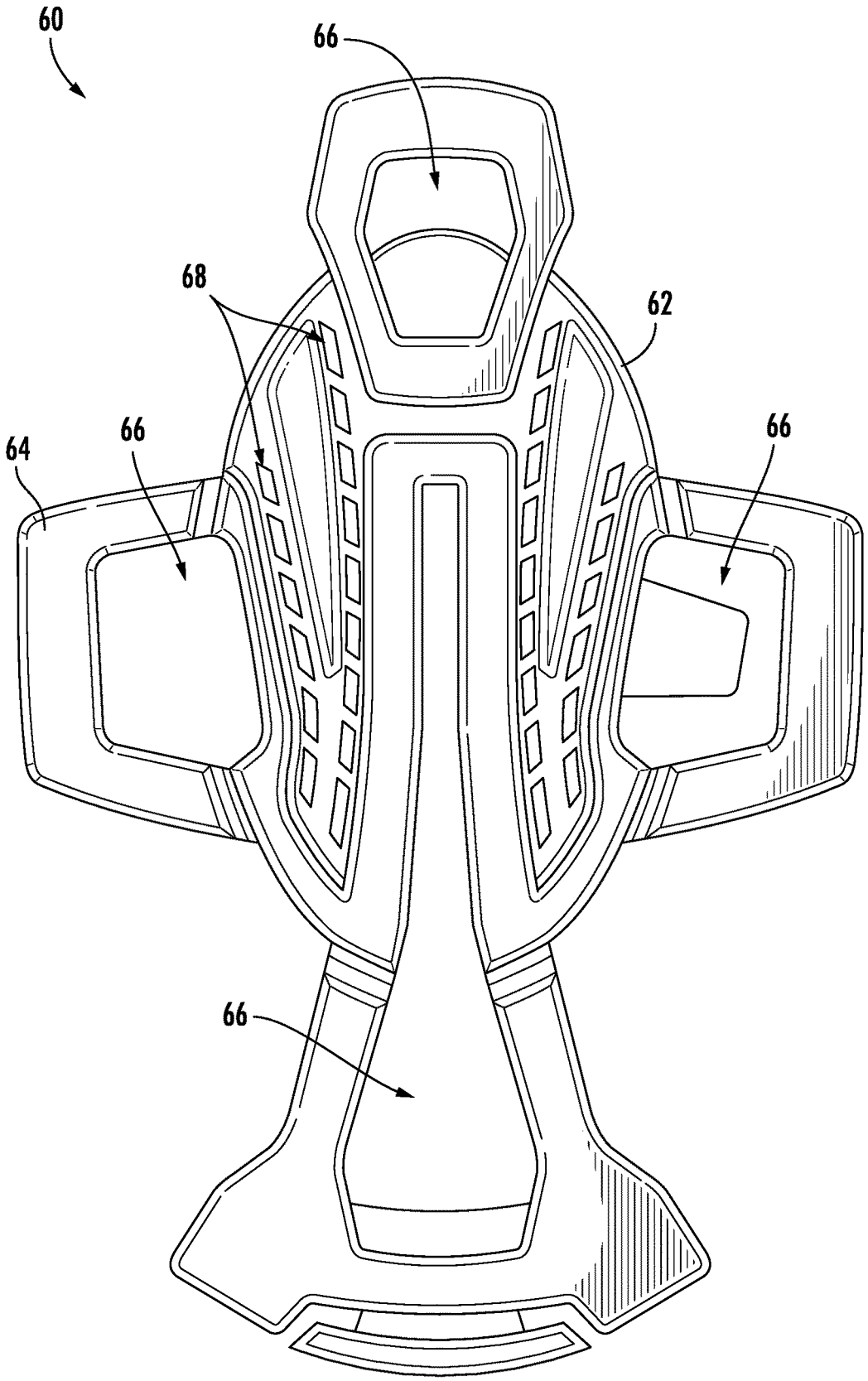
FIG. 4 is a bottom view of an impact absorbing liner, according to an exemplary embodiment.

Referring to FIG. 4, a bottom view of an impact absorbing liner 60 is shown according to an exemplary embodiment. Impact absorbing liner 60 can be utilized with an outer shell such as outer shell 12 to form a bump cap such as bump cap 10. When bump cap 10 is assembled, impact absorbing liner 60 is positioned and/or coupled within cavity 22 of outer shell 12. Impact absorbing liner 60 includes an outer surface 62 facing interior surface 20 of outer shell 12 and an inner surface 64 facing inward (i.e., toward the bump cap wearer 16). Applicant believes impact absorbing liner 60 provides improved engagement and/or grip between impact absorbing liner 60 and a head of the bump cap wearer 16, reducing rotation between the bump cap 10 and wearer 16 to improve impact performance. In a specific embodiment, impact absorbing liner 60 is formed from a polymer foam material. In a specific embodiment, impact absorbing liner 60 is formed from expanded polystyrene (EPS). In another specific embodiment, impact absorbing liner 60 is formed from a moisture wicking material.

Impact absorbing liner 60 includes a plurality of openings or vents 66. Vents 66 extend through impact absorbing liner 60 providing fluid communication between cavity 22 and the ambient air proximate to exterior surface 18 of outer shell 12 even when bump cap 10 is assembled (see e.g., FIG. 5). In a specific embodiment, impact absorbing liner 60 includes a plurality of apertures 68 that act as vents. Apertures 68 extend through impact absorbing liner 60 providing fluid communication between cavity 22 and the ambient air proximate to exterior surface 18 of outer shell 12 even with bump cap 10 assembled (see e.g., FIG. 5). In a specific embodiment, vents 66 have a first size and apertures 68 have a second size less than the first size.

Figure 5:
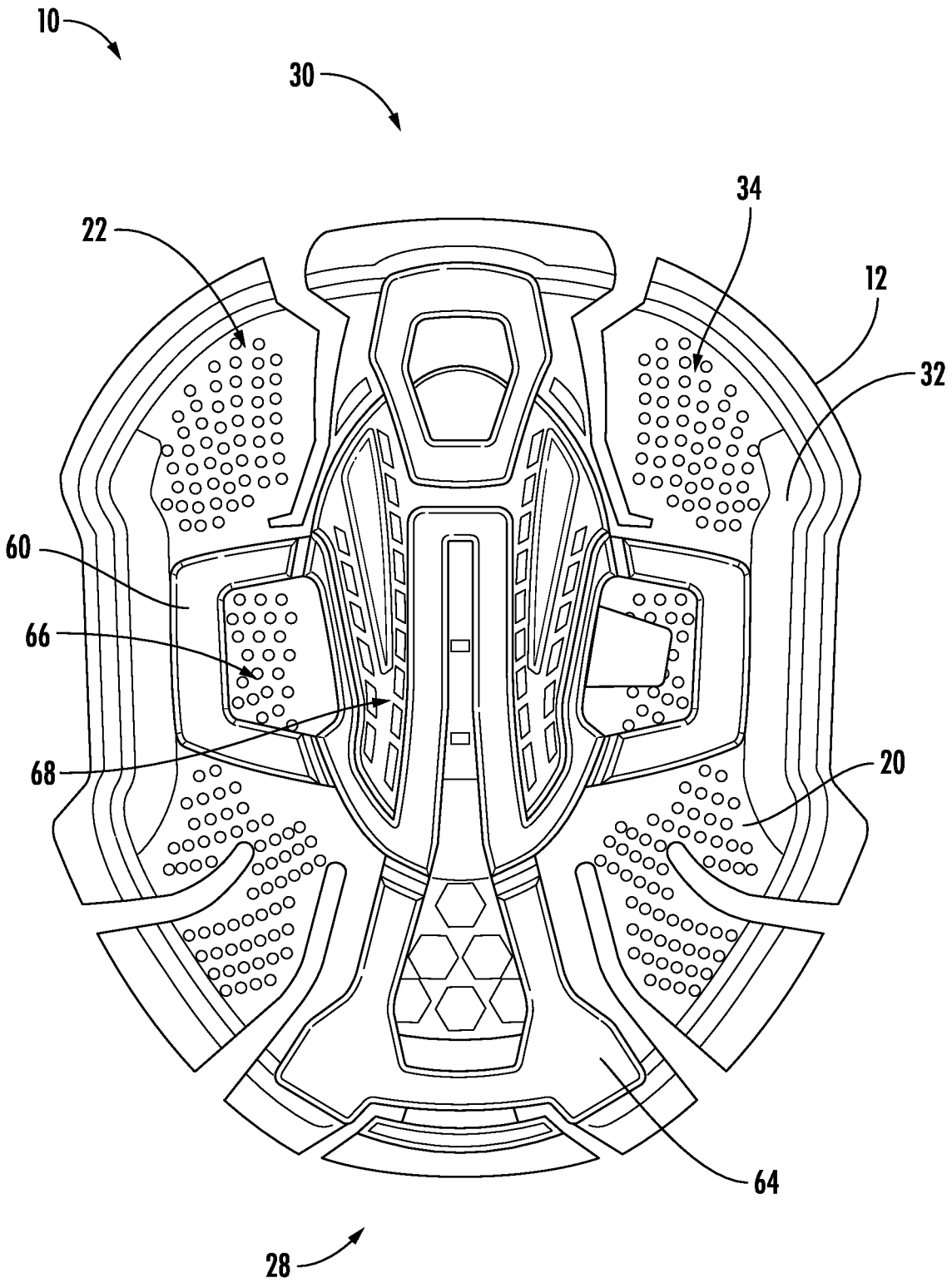
FIG. 5 is a view from below of a bump cap with the impact absorbing liner of FIG. 4, according to an exemplary embodiment.
Figure 6:
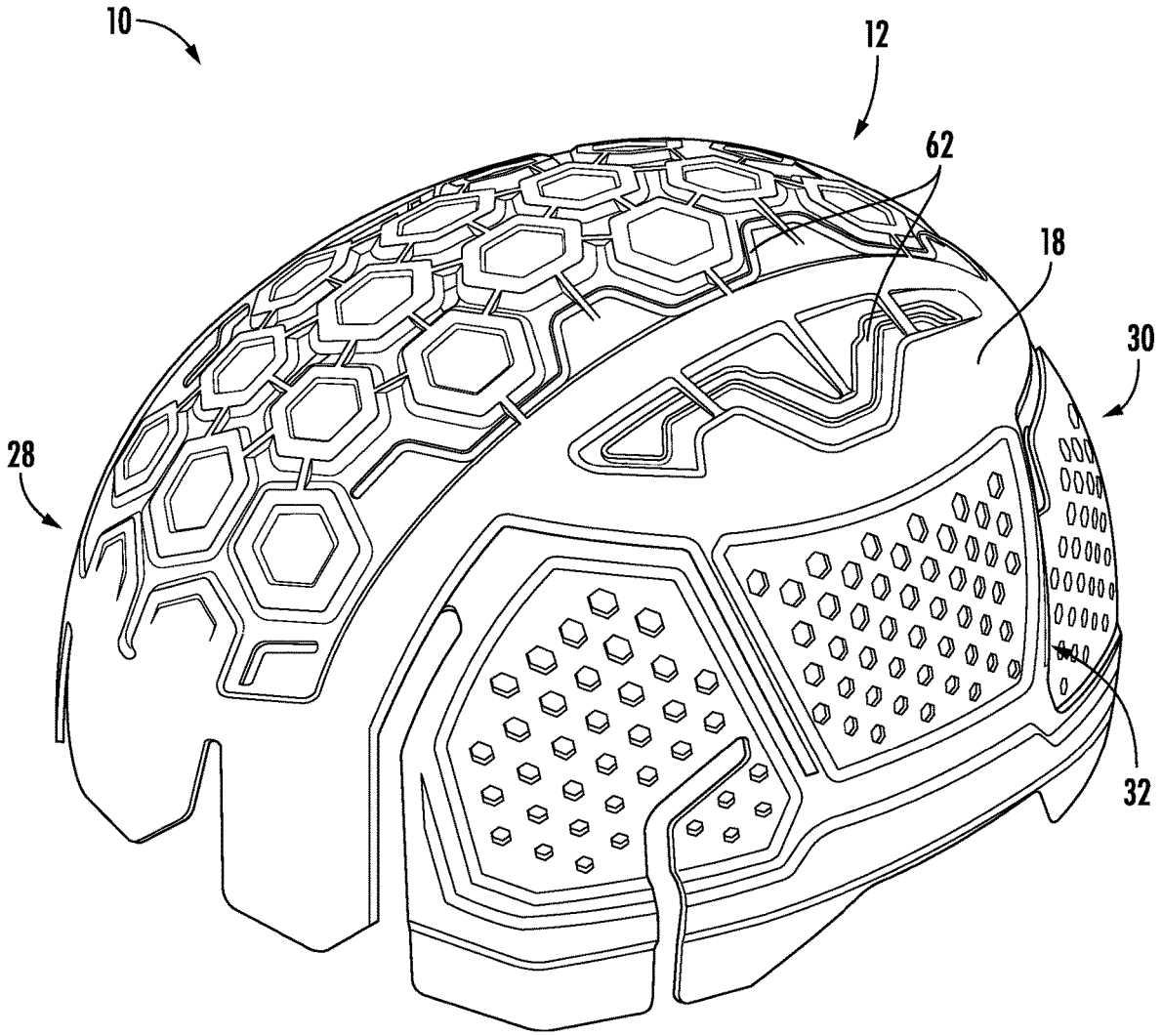
FIG. 6 is a perspective view of the bump cap of FIG. 5, according to an exemplary embodiment.

Referring to FIGS. 5-6, bump cap 10 is shown fully assembled (i.e., including both outer shell 12 and impact absorbing liner 60), according to an exemplary embodiment. In a specific embodiment, vents 66 are positioned along interior surface 20 of at least one of opposing side portions 32, front portion 28, and/or rear portion 30 of outer shell 12. In a specific embodiment, apertures 68 are positioned along interior surface 20 at the crown 24 (i.e., between opposing side portions 32).

Figure 7:
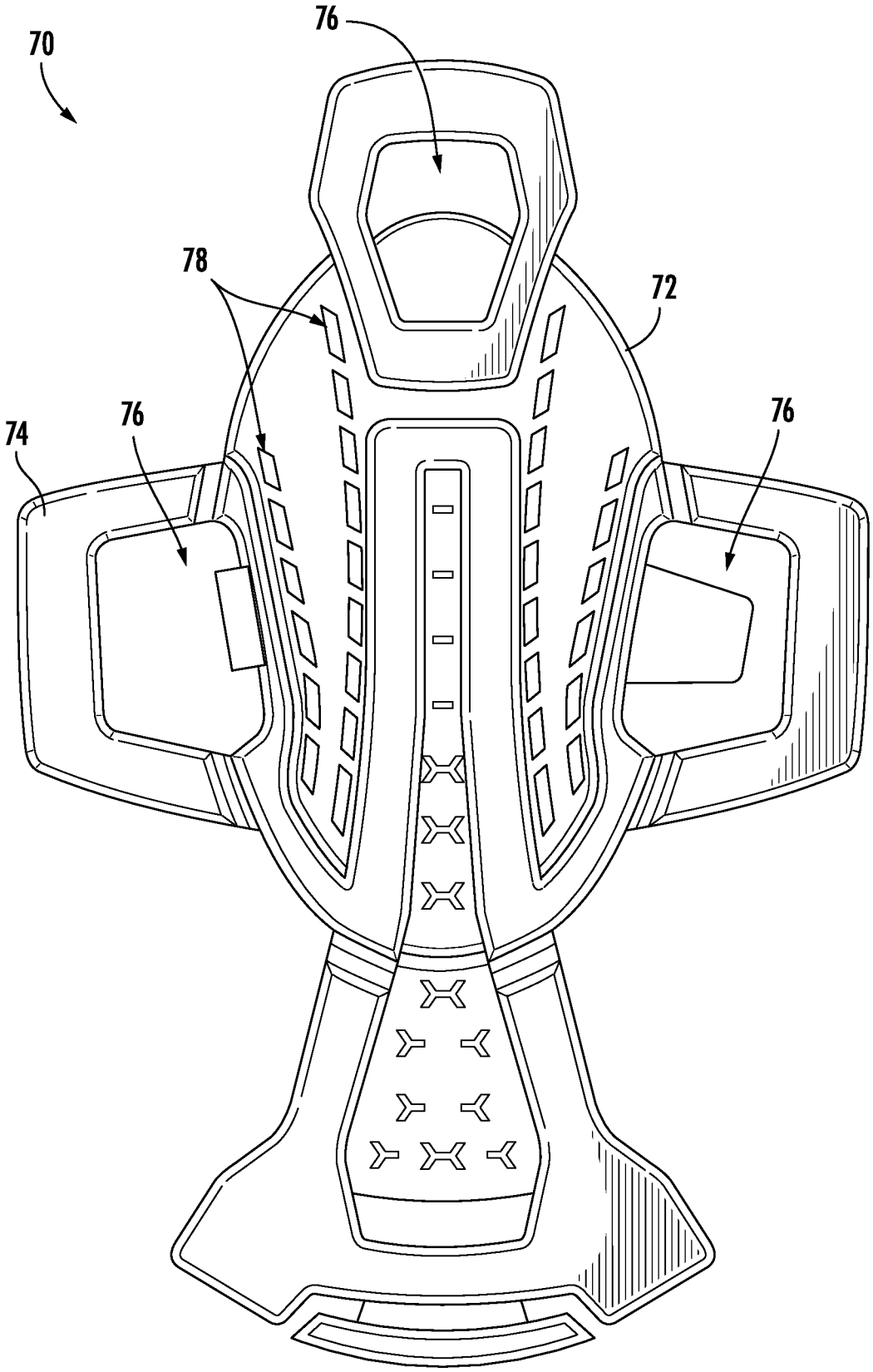
FIG. 7 is a bottom view of an impact absorbing liner, according to another exemplary embodiment.
Figure 8:
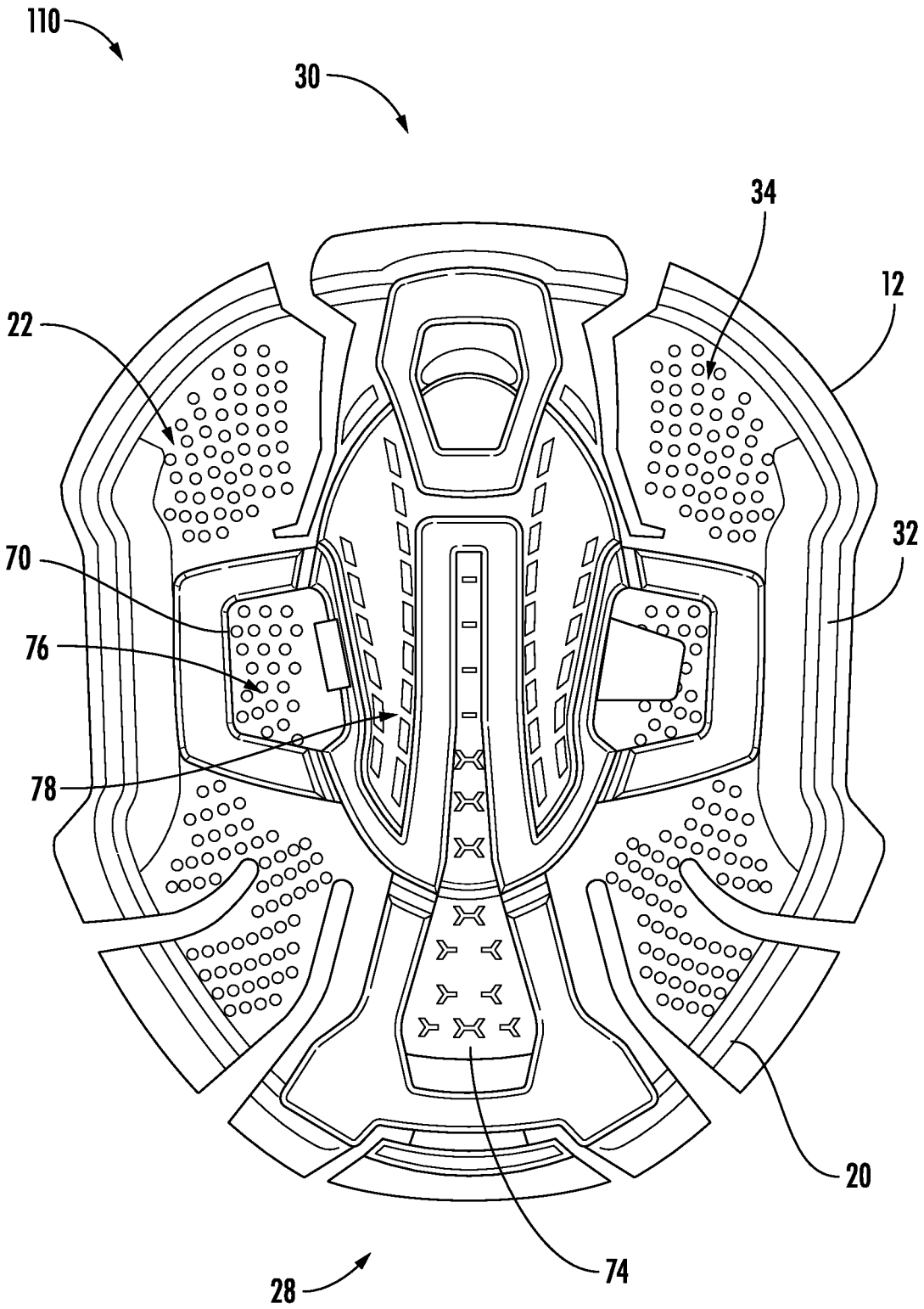
FIG. 8 is a view from below of a bump cap with the impact absorbing liner of FIG. 7, according to an exemplary embodiment.
Figure 9:
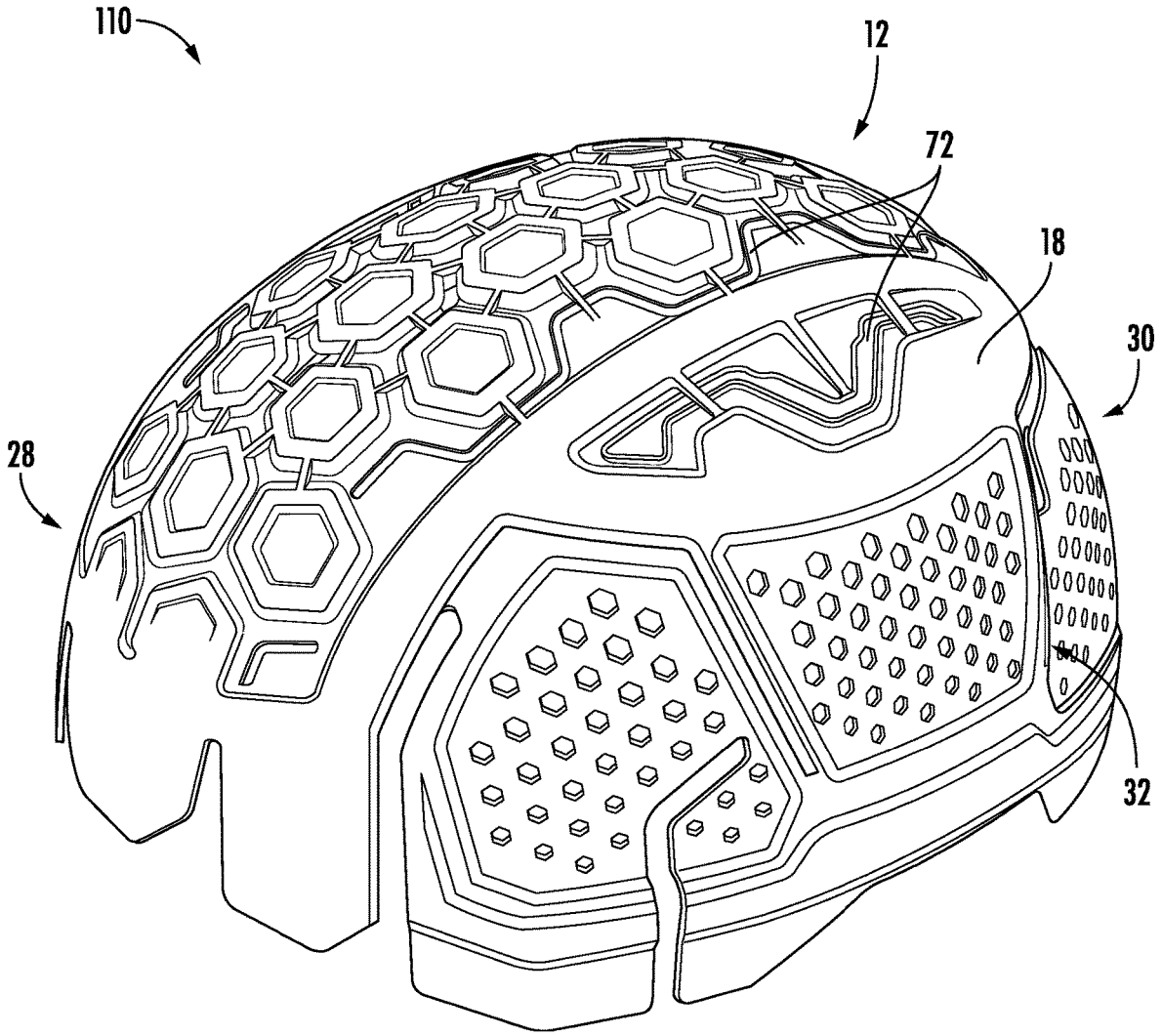
FIG. 9 is a perspective view of the bump cap of FIG. 8, according to an exemplary embodiment.

Referring to FIGS. 7-9, views of an impact absorbing liner 70 and bump cap 110 are shown according to another exemplary embodiment. Bump cap 110 includes outer shell 12 and can be utilized with the impact absorbing liner 70. Bump cap 110 is substantially the same as bump cap 10 except for the differences discussed herein. Bump cap 110 includes the protective outer shell 12 and impact absorbing liner 70 (see e.g., FIGS. 8-9).

Referring to FIG. 7, a bottom view of an impact absorbing liner 70 is shown according to an exemplary embodiment. Impact absorbing liner 70 can be utilized with an outer shell such as outer shell 12 to form a bump cap such as bump cap 110. When bump cap 110 is assembled, impact absorbing liner 70 is positioned and/or coupled within cavity 22 of outer shell 12. Impact absorbing liner 70 includes an outer surface 72 facing interior surface 20 of outer shell 12 and an inner surface 74 facing inward (i.e., toward the bump cap wearer 16). Applicant believes impact absorbing liner 70 provides engagement and/or grip between impact absorbing liner 70 and a head of the bump cap wearer 16, reducing rotation between the bump cap 110 and wearer 16 to improve impact performance.

In various embodiments, impact absorbing liner 70 is formed from a strain rate sensitive material meaning the properties of impact absorbing liner 70 change with increasing strain rate. Specifically, in such embodiments, impact absorbing liner 70 is a material in which the rigidity of the impact absorbing liner 70 increases under impact. In some embodiments, impact absorbing liner 70 is a dilatant material (shear thickening material). In various embodiments, impact absorbing liner 70 includes a plurality of cells. In a specific embodiment, the cells of the impact absorbing liner 70 have an anisotropic geometry such that the material has a different response and behavior to mechanical deformation in all three directions (X, Y, Z). In another specific embodiment, impact absorbing liner 70 is formed from a moisture wicking material.

Impact absorbing liner 70 includes a plurality of openings or vents 76. Vents 76 extend through impact absorbing liner 70 providing fluid communication between cavity 22 and the ambient air proximate to exterior surface 18 of outer shell 12 even with bump cap 110 assembled (see e.g., FIG. 8). In a specific embodiment, impact absorbing liner 70 includes a plurality of apertures 78 that act as vents. Apertures 78 extend through impact absorbing liner 70 providing fluid communication between cavity 22 and the ambient air proximate to exterior surface 18 of outer shell 12 even with bump cap 110 assembled (see e.g., FIG. 8). In a specific embodiment, vents 76 have a first size and apertures 78 have a second size less than the first size.

Referring to FIGS. 8-9, bump cap 110 is shown fully assembled (i.e., including both outer shell 12 and impact absorbing liner 70), according to an exemplary embodiment. In a specific embodiment, vents 76 are positioned along interior surface 20 of at least one of opposing side portions 32, front portion 28, and/or rear portion 30 of outer shell 12. In a specific embodiment, apertures 78 are positioned along interior surface 20 at the crown 24 (i.e., between opposing side portions 32).

Figure 10:
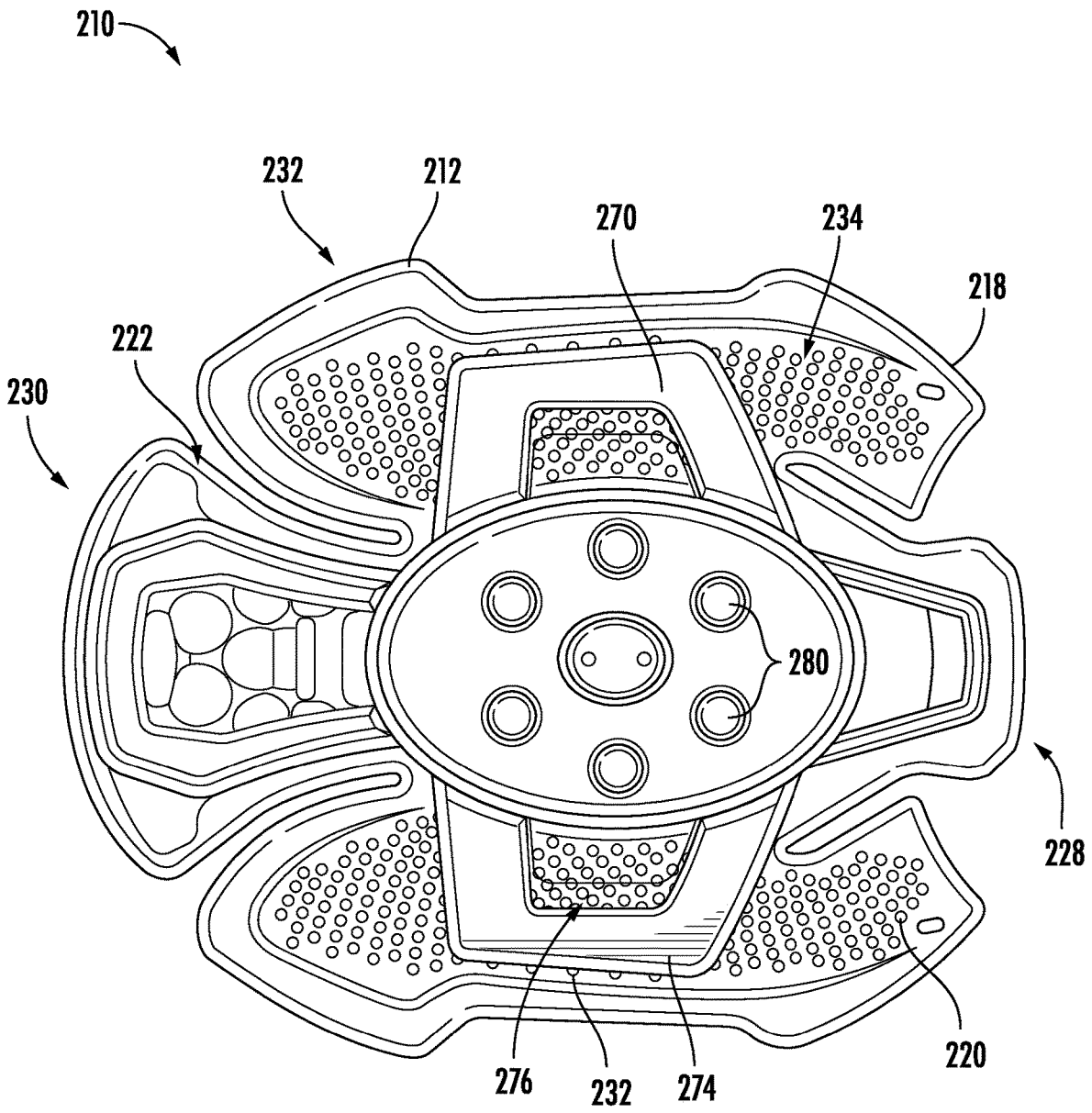
FIG. 10 is a view from below of a protective cap with an impact absorbing liner, according to another exemplary embodiment.

Referring to FIG. 10, a perspective view from below of a bump cap 210 is shown according to another exemplary embodiment. Bump cap 210 can be utilized with impact absorbing liners 60 or 70 and/or an outer shell such as outer shell 12. Bump cap 210 is substantially the same as bump cap 10 and 110 except for the differences discussed herein and the components of bump cap 210 have been given the same reference number plus 100 or 200 respectively.

Bump cap 210 includes a protective outer shell 212 and an impact absorbing liner 270. In a specific embodiment, outer shell 212 is formed from a rigid material, such as a rigid polymer material. Outer shell 212 includes an exterior surface 218 and an interior surface 220. Interior surface 220 defines a cavity 222 sized to receive a head of a user and/or wearer. Outer shell 212 further includes a front portion 228 and a rear portion 230 that opposes front portion 228. A pair of opposing side portions 232 of outer shell 212 extend downward (i.e., toward wearer) from a crown between front portion 228 and rear portion 230 of outer shell 212. Outer shell 212 further includes a plurality of apertures or vents 234. Vents 234 extend through outer shell 212 providing fluid communication between cavity 222 and the ambient air proximate to exterior surface 218 of outer shell 212.

When bump cap 210 is assembled, impact absorbing liner 270 is positioned and/or coupled within cavity 222 of outer shell 212. Impact absorbing liner 270 includes an outer surface (see e.g., 72 in FIG. 9) facing interior surface 220 of outer shell 212 and an inner surface 274 facing inward (i.e., toward the bump cap wearer). Applicant believes impact absorbing liner 270 provides engagement and/or grip between impact absorbing liner 270 and a head of the bump cap wearer, reducing rotation between the bump cap 210 and the wearer to improve impact performance.

The impact absorbing liner 270 includes a plurality of structures, shown as plugs 280. Plugs 280 extend toward interior surface 220 of outer shell 212 and engage interior surface 220 and/or outer shell 212 to securely hold and/or lock impact absorbing liner 270 to outer shell 212. Applicant believes, this engagement between the plugs 280 of impact absorbing liner 270 and outer shell 212 reduces rotation between bump cap 210 and the impact absorbing liner to further improve impact performance. In various embodiments, impact absorbing liner 270 includes other structures to securely couple impact absorbing liner 270 to outer shell 212 (i.e., clips, snaps, etc.).

Figure 11:
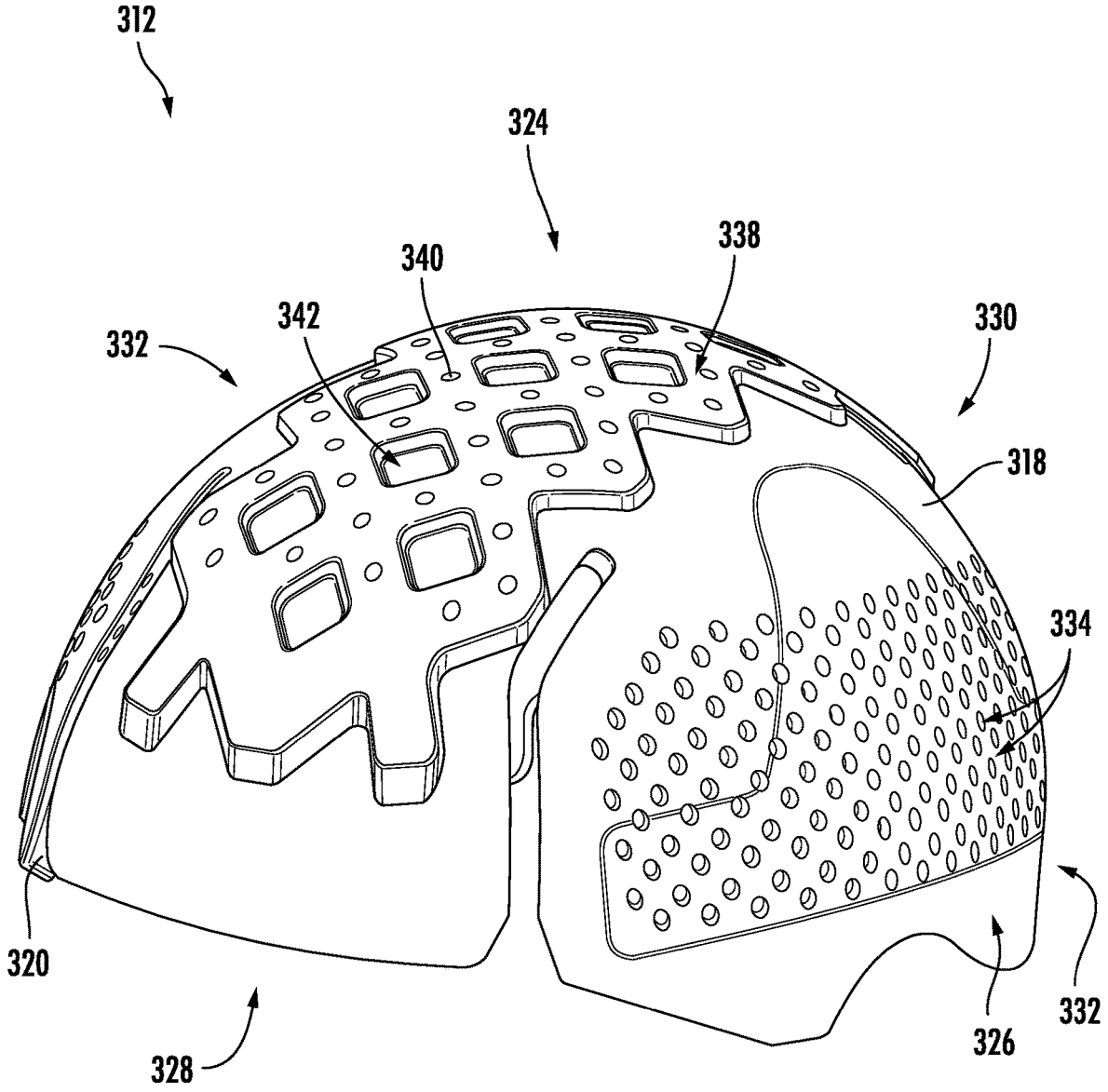
FIG. 11 is a perspective view of an outer shell, according to another exemplary embodiment.
Figure 12:
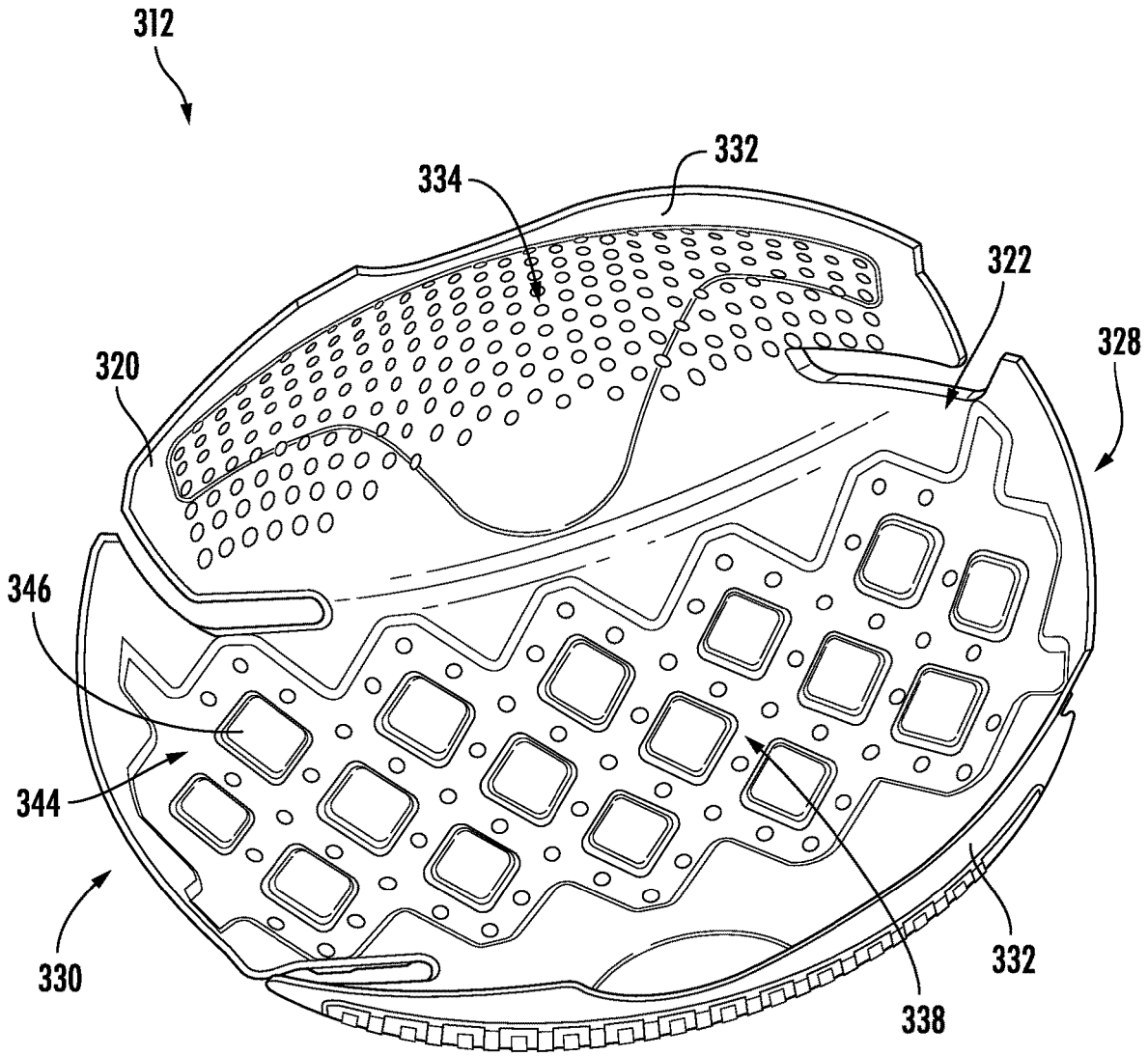
FIG. 12 is a perspective view from below of the outer shell of FIG. 11, according to an exemplary embodiment.

Referring to FIGS. 11-12, views of an outer shell 312 for a bump cap are shown according to another exemplary embodiment. Outer shell 312 can be utilized with the impact absorbing liners 60, 70 and/or 270. Outer shell 312 is substantially the same as outer shells 12, 212 except for the differences discussed herein. Outer shell 312 includes an exterior surface 318 and an interior surface 320 Interior surface 320 defines a cavity 322 (see e.g., FIG. 12) sized to receive a head of a user and/or wearer. Exterior surface 318 of outer shell 312 faces and/or engages with an inner surface of a hat or cap (see e.g., 14 in FIG. 1).

Outer shell 312 includes a crown 324 and a bottom segment 326 defining a lower circumference of the outer shell 312. Outer shell 312 further includes a front portion 328 and a rear portion 330 that opposes front portion 328. A pair of opposing side portions 332 of outer shell 312 extend downward (i.e., toward wearer of the bump cap) from crown 324 and extend between front portion 328 and rear portion 330. In a specific embodiment, outer shell 312 includes a plurality of apertures or vents 334. Vents 334 extend through outer shell 312 providing fluid communication between cavity 322 and the ambient air proximate to exterior surface 318 of outer shell 312. In a specific embodiment, vents 334 are positioned along opposing side portions 332 of outer shell 312. In other embodiments, vents 334 are positioned on other portions of outer shell 12 (i.e., crown, front, rear, etc.).

Exterior surface 318 of outer shell 312 and specifically crown 324 includes a patterned or textured portion 338. As discussed above, Applicant believes the patterned portion 338 on outer shell 312 provides a grip between the bump cap and a hat (see e.g., 14 in FIG. 1) the user may wear over the bump cap, reducing rotation between the exterior surface 318 of outer shell 312 and an inner surface of the hat.

In a specific embodiment, the patterned portion 338 extends along crown 324 between front portion 328 and rear portion 330 of outer shell 312. Sections of the patterned portion 338, include raised or protruding structures 340 that extend away from the exterior surface 318 and other sections are sunken 342 relative to the protruding structures 340 (i.e., recessed relative to the outer surface of structure 340). In a specific embodiment, patterned portion 338 and specifically protruding structures 340 include a cross-hatching shaped pattern. In other embodiments, patterned portion 338 includes a pattern with a different shape (i.e., triangular, square, hexagonal, etc.). In a specific embodiment, the sunken or recessed section 342 of patterned portion 338 has a quadrilateral shape (i.e., rhombus, parallelogram, rectangle, square, etc.). In other embodiments, sunken or recessed section 342 of patterned portion 338 is a different shape (i.e., triangular, square, hexagonal, polygonal, etc.).

Referring to FIG. 12, a perspective view from below of the outer shell 312 is shown according to an exemplary embodiment. Outer shell 312 includes a surface pattern on the interior surface 320 (i.e., surface engaged with impact absorbing liner) grips and/or secures the impact absorbing liner to the outer shell 312 and reduce rotation between the outer shell 312 and the impact absorbing liner. Protruding structures 340 create corresponding recessed structures 344 along interior surface 320. Similarly, sunken sections 342 on exterior surface 318 create corresponding protrusions 346 that extend inward away from interior surface 320 (i.e., toward impact absorbing liner and/or bump cap user).

Figure 13:
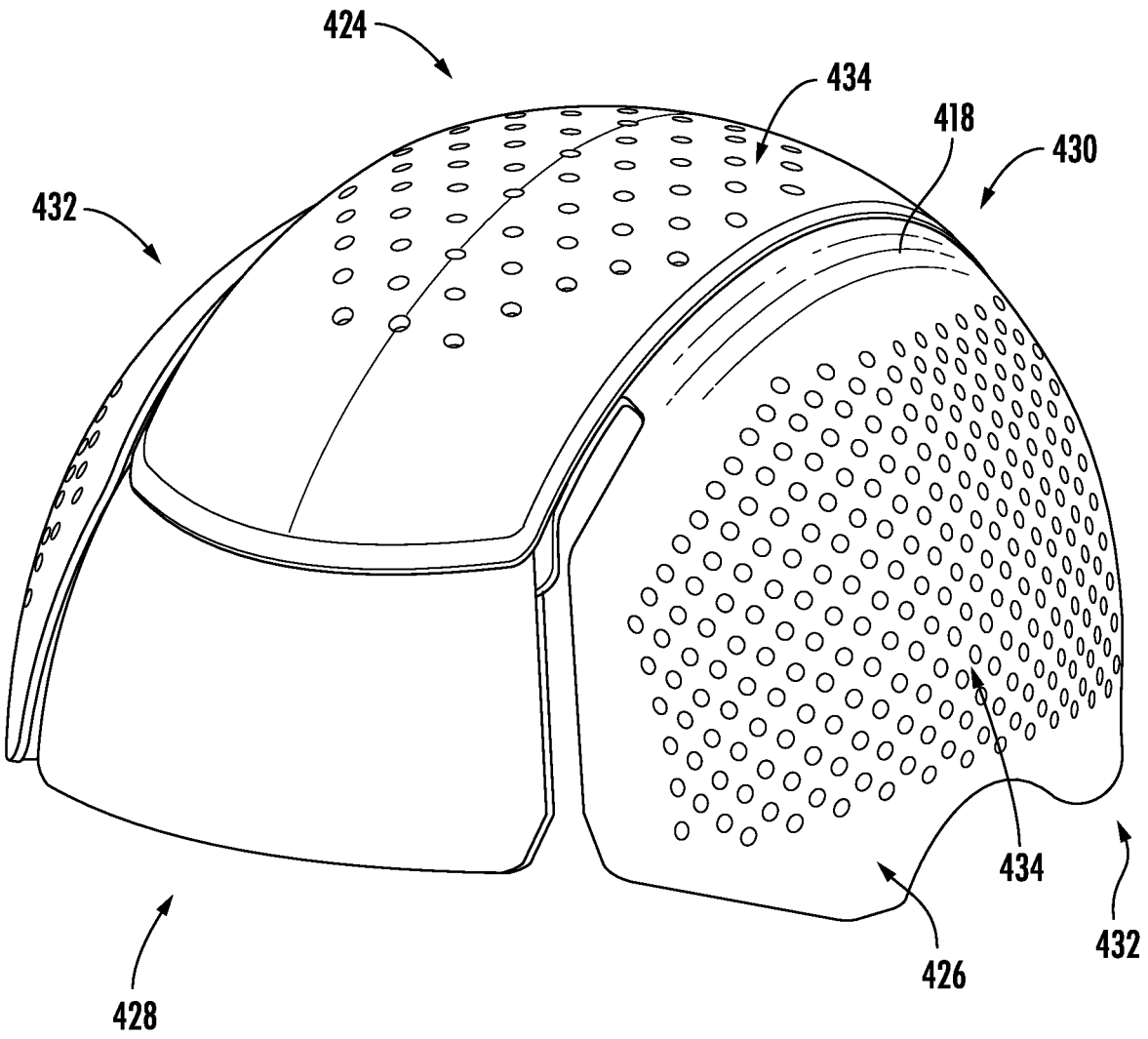
FIG. 13 is a perspective view of a protective outer shell, according to another exemplary embodiment.
Figure 14:
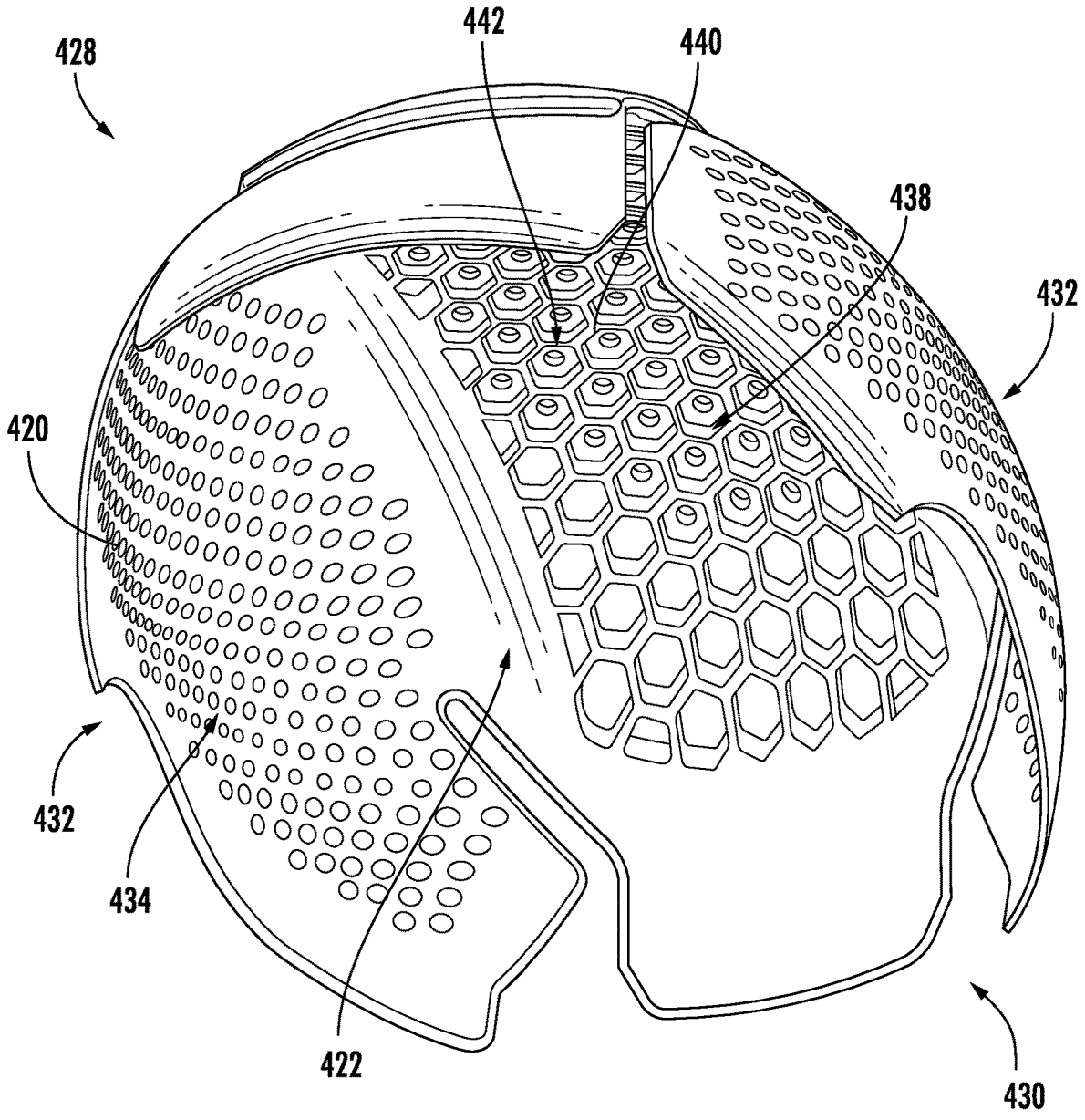
FIG. 14 is a perspective view from below of the outer shell of FIG. 13, according to an exemplary embodiment.

Referring to FIGS. 13-14, views of an outer shell 412 for a bump cap are shown according to another exemplary embodiment. Outer shell 412 can be utilized with the impact absorbing liners 60, 70 and/or 270. Outer shell 412 is substantially the same as outer shells 12, 212, 312 except for the differences discussed herein. Outer shell 412 includes an exterior surface 418 and an interior surface 420 Interior surface 420 defines a cavity 422 (see e.g., FIG. 14) sized to receive a head of a user and/or wearer. Exterior surface 418 of outer shell 412 faces and/or engages with an inner surface of a hat or cap (see e.g., 14 in FIG. 1).

Outer shell 412 includes a crown 424 and a bottom segment 426 defining a lower circumference of the outer shell 412. Outer shell 412 further includes a front portion 428 and a rear portion 430 that opposes front portion 428. A pair of opposing side portions 432 of outer shell 312 extend downward (i.e., toward wearer of the bump cap) from crown 424 and are positioned between front portion 428 and rear portion 430. In a specific embodiment, outer shell 412 includes a plurality of apertures or vents 434. Vents 434 extend through outer shell 412 providing fluid communication between cavity 422 and the ambient air proximate to exterior surface 418 of outer shell 412. In a specific embodiment, vents 434 are positioned along opposing side portions 432 of outer shell 312. In other embodiments, vents 434 are positioned on other portions of outer shell 412 (i.e., crown, front, rear, etc.).

Interior surface 420 of outer shell 412 and specifically crown 424 includes a patterned or textured portion 438. As discussed above, Applicant believes the patterned portion 438 on outer shell 412 provides a grip and/or secures the impact absorbing liner to the outer shell 412 and reduces rotation between the outer shell 412 and the impact absorbing liner.

In a specific embodiment, the patterned portion 438 extends along crown 424 between front portion 428 and rear portion 430 of the interior surface 420 of outer shell 412. Sections of the patterned portion 438, include raised or protruding structures 440 that extend away from the interior surface 420 (i.e., toward the wearer of the bump cap) and other sections are sunken or recessed 442 relative to the protruding structures 440. In a specific embodiment, patterned portion 438 and specifically protruding structures 440 include a hexagonal or honeycomb shaped pattern. In other embodiments, patterned portion 438 includes a different shape (i.e., triangular, square, polygonal, etc.).

Figure 15:
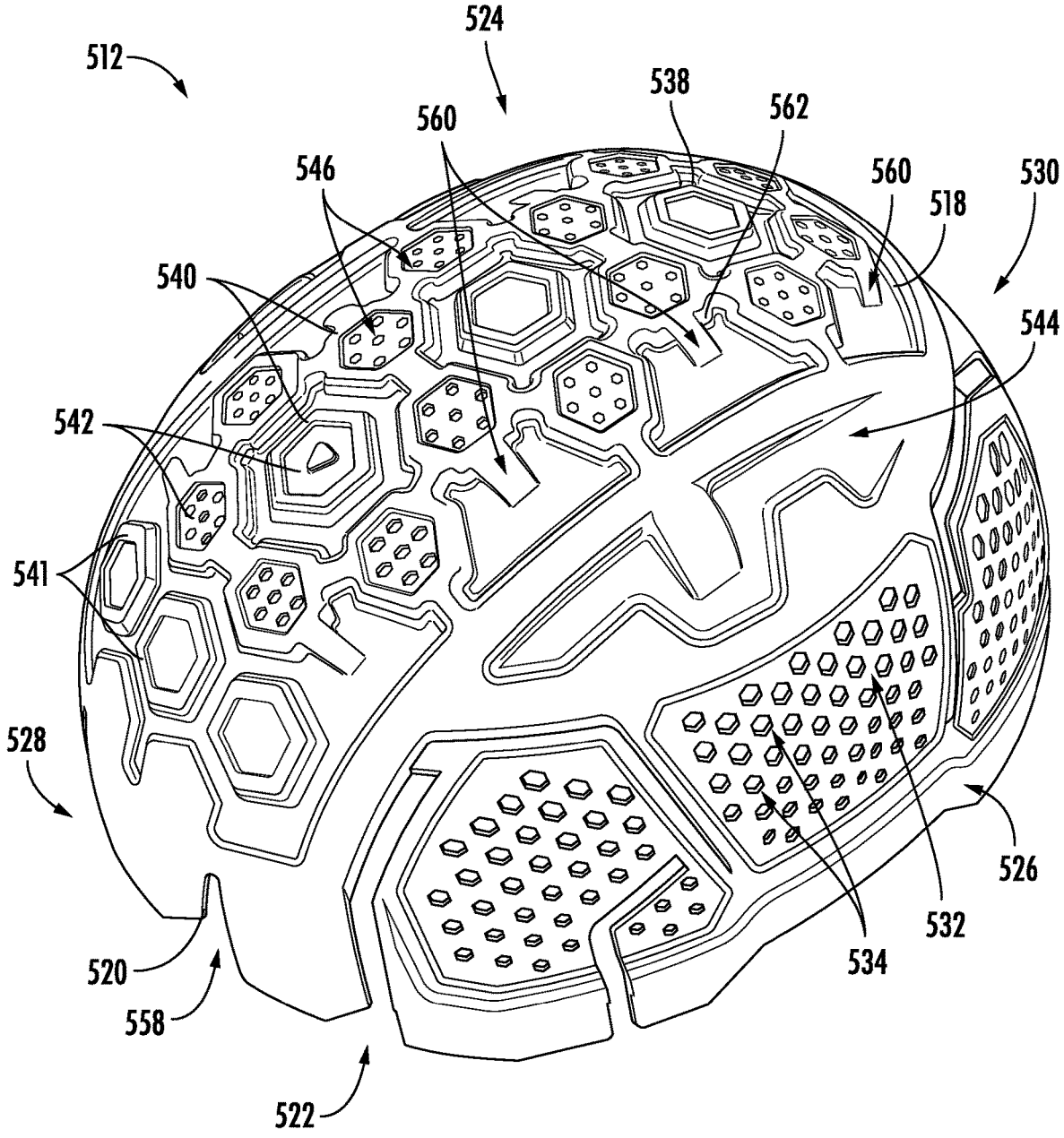
FIG. 15 is a perspective view of an outer shell of a bump cap, according to another exemplary embodiment.

Referring to FIG. 15, a perspective view of an outer shell 512 for a bump cap are shown according to another exemplary embodiment. Outer shell 512 can be utilized with the impact absorbing liners 60, 70 and/or 270. Outer shell 512 is substantially the same as outer shells 12, 212, 312, and 412 except for the differences discussed herein. Outer shell 512 includes an exterior surface 518 and an interior surface 520. Interior surface 520 defines a cavity 522 (see e.g., FIG. 12) sized to receive a head of a user and/or wearer. Exterior surface 518 of outer shell 512 faces and/or engages with an inner surface of a hat or cap (see e.g., 14 in FIG. 1).

Outer shell 512 includes a crown 524 and a bottom segment 526 defining a lower circumference of the outer shell 512. Outer shell 512 further includes a front portion 528 and a rear portion 530 that opposes front portion 528. A pair of opposing side portions 532 of outer shell 512 extend downward (i.e., toward wearer of the bump cap) from crown 524 and extend between front portion 528 and rear portion 530. In a specific embodiment, outer shell 512 includes a plurality of apertures or vents 534. Vents 534 extend through outer shell 512 providing fluid communication between cavity 522 and the ambient air proximate to exterior surface 518 of outer shell 512. In a specific embodiment, vents 534 are positioned along opposing side portions 532 of outer shell 512. In other embodiments, vents 534 are positioned on other portions of outer shell 512 (i.e., crown, front, rear, etc.).

Exterior surface 518 of outer shell 512 and specifically crown 524 includes a patterned or textured portion 538. As discussed above, Applicant believes the patterned portion 538 on outer shell 512 provides a grip between the bump cap and a hat (see e.g., 14 in FIG. 1) the user may wear over the bump cap, reducing rotation between the exterior surface 518 of outer shell 512 and an inner surface of the hat.

In a specific embodiment, the patterned portion 538 extends along crown 524 between front portion 528 and rear portion 530 of outer shell 512. Sections of the patterned portion 538, include raised or protruding structures 540 that extend away from the exterior surface 518 and other sections are sunken 542 relative to the protruding structures 540 (i.e., recessed relative to the outer surface of structure 540). Protruding structures 540 each have an outer surface 541, and outer surfaces 541 of protruding structures 540 together define the outermost surface of the crown 524. In various embodiments, sunken sections 542 is positioned within the protruding structures 540 and recessed relative to the protruding structures 540.

In various specific embodiments, patterned portion 538 and specifically protruding structures 540 include a hexagonal shaped pattern. In various other embodiments, patterned portion 538 includes a pattern with a different shape (i.e., triangular, square, octagonal, etc.). In various specific embodiments, patterned portion 538 and specifically sunken portion 542 includes a hexagonal shaped pattern. In other embodiments, sunken or recessed section 542 of patterned portion 538 is a different shape (i.e., triangular, square, octagonal, polygonal, etc.).

In a specific embodiment, sunken vents 546 are positioned within sunken section 542. Sunken vents 546 extend through outer shell 512 providing fluid communication between cavity 522 and the ambient air proximate to exterior surface 518 of outer shell 512. Applicant believes that by locating sunken vents 546 within sunken section 542 (and located below/closer to the wear's head than the outer surfaces 41 of protruding structure 40) that airflow is improved.

In various embodiments, outer shell 512 further includes one or more recessed portions 544. Recessed portions 544 are positioned between crown 524 and opposing side portions 532 of outer shell 512. In such embodiments, recessed portions 544 are recessed below (i.e., closer to head of the wearer) than both protruding structures 540 and sunken central areas 542 of the patterned portion 538.

In various embodiments, outer shell 512 includes one or more ramps or sloping surfaces 560. Ramps 560 are coupled to and extend from one or more side surfaces 562 of protruding structures 540. Applicant believes the ramps 560 reduce and/or prevent outer shell 512 and the bump cap in general from snagging or becoming caught on objects while the user is wearing the bump cap. In various embodiments, the ramps 560 have a smooth surface.

In various embodiments, one or more ramps 560 are coupled to the exterior surface 518 of outer shell 512 and extend upward toward the patterned portion 538 and/or crown 524. In a specific embodiment, one or more ramps 560 extend at an angle upward from one or more of the opposing side portions 532 toward the crown 524. In other words, the lowest portion (i.e., closest to exterior surface 518) of the ramp is positioned adjacent to the side portion 532 and the highest portion (i.e., further away from exterior surface 518) of the ramp 560 is positioned adjacent to crown 524.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed:

1. A protective cap comprising:
an outer shell, the outer shell comprising:
an exterior surface, the exterior surface comprising:
a patterned portion, the patterned portion configured to engage an inner surface of headwear covering the protective cap, the patterned portion comprising:
a plurality of protruding structures each extending away from the exterior surface; and
a plurality of sunken central sections, each recessed relative to one of the plurality of protruding structures, wherein each of the sunken central sections is completely surrounded by one of the plurality of protruding structures;
an interior surface defining a cavity sized to receive a head of a user;
a crown portion, the crown portion configured to cover part of the head of the user; and
a bottom segment, the bottom segment defining a lower circumference of the outer shell;
an impact absorbing liner positioned within the outer shell and engaged with the interior surface of the outer shell-
a front portion;
a rear portion;
a pair of side portions extending downward from the crown portion and positioned between the front portion and the rear portion, each of the pair of side portions comprising:
a side recessed portion;
a plurality of side vents:
wherein the side recessed portion is positioned above the plurality of side vents; wherein the plurality of side vents is positioned below the side recessed portion and above the bottom segment.

2. The protective cap of claim 1, wherein the patterned portion extends along the crown portion between the front portion and the rear portion of the outer shell.

3. The protective cap of claim 1, wherein each of the protruding structures of the patterned portion is a hexagonal shaped structure.

4. The protective cap of claim 1, further comprising one or more vents positioned on the plurality of sunken central sections, the vents extending through the outer shell between the interior surface and the exterior surface to provide fluid communication between the cavity and ambient air proximate to the exterior surface of the outer shell.

5. The protective cap of claim 1, further comprising ramps coupled to the outer shell and extending upward from the exterior surface of the outer shell toward the patterned portion.

6. The protective cap of claim 1, wherein, when the patterned portion engages an inner surface of the headwear, the patterned portion resists relative rotation between the headwear and the outer shell.

7. The protective cap of claim 1, further comprising one or more slots defined in the outer shell, the slots extending from the bottom segment toward the crown portion.

8. The protective cap of claim 7, wherein the one or more slots are vertical slots positioned on the front portion or the rear portion of the outer shell.

9. A bump cap comprising:
an outer shell, the outer shell comprising:
an exterior surface, the exterior surface comprising:
a patterned portion, the patterned portion comprising:
a plurality of protruding structures each extending away from the exterior surface; and
a plurality of sunken central sections, each recessed relative to one of the plurality of the protruding structures, wherein each of the sunken central sections is completely surrounded by one of the plurality of protruding structures;
an interior surface defining a cavity sized to receive a head of a user;
a crown portion, the crown portion configured to cover part of the head of the user;
a bottom segment, the bottom segment defining a lower circumference of the outer shell;
a front portion;
a rear portion that opposes the front portion;
a pair of side portions extending downward from the crown portion and positioned between the front portion and the rear portion; and
a trimmable section extending along the bottom segment of each of the pair of side portions, the trimmable section comprising a shoulder extending along a longitudinal axis of the bump cap, wherein the shoulder provides a transition between a thick section of the outer shell and a thin section of the outer shell; and an impact absorbing liner positioned within the outer shell and coupled to the interior surface of the outer shell.

10. The bump cap of claim 9, wherein the thick section has a first thickness and the thin section has a second thickness, and wherein the first thickness is greater than the second thickness.

11. The bump cap of claim 9, wherein the shoulder is a stepped transition between the thick section of the outer shell and the thin section of the outer shell.

12. The bump cap of claim 9, the each of the pair of side portions comprising:

a side recessed portion located along the side portion; and a plurality of side vents;

wherein the side recessed portion is positioned above the plurality of side vents; and wherein the plurality of side vents is positioned below the side recessed portion and above the bottom segment.

13. The bump cap of claim 9, further comprising one or more vertical slots defined in the outer shell, the vertical slots positioned on at least one of the front portion and the rear portion, wherein the vertical slots extend from the bottom segment toward the crown portion.

14. The bump cap of claim 9, wherein the outer shell is formed from a rigid polymer material and the impact absorbing liner is formed from a polymer foam material.

15. A bump cap comprising:

an outer shell, the outer shell comprising:

a crown portion, the crown portion configured to cover part of a head of a user;

a bottom segment, the bottom segment defining a lower circumference of the outer shell;

an exterior surface;

a plurality of protruding structures each extending away from the exterior surface; and a plurality of sunken sections, each sunken section positioned within one of the plurality of protruding structures and recessed relative to the protruding structure, wherein each of the sunken sections is completely surrounded by one of the plurality of protruding structures;

an interior surface defining a cavity sized to receive the head of the user; and an impact absorbing liner positioned within the outer shell and engaged with the interior surface of the outer shell; and a trimmable section extending along the bottom segment of the outer shell, wherein the trimmable section comprises a step, and wherein the step provides a transition between a thick portion of the outer shell and a thin portion of the outer shell.

16. The bump cap of claim 15, wherein each of the plurality of sunken sections has a polygonal shape.

17. The bump cap of claim 15, further comprising one or more slots defined in the outer shell, the slots extending from the bottom segment toward the crown portion.

* * * * *